US010914319B2

(12) United States Patent
Saburi et al.

(10) Patent No.: US 10,914,319 B2
(45) Date of Patent: Feb. 9, 2021

(54) COOLING DEVICE AND COMPRESSOR SYSTEM

(71) Applicant: MITSUBISHI HEAVY INDUSTRIES COMPRESSOR CORPORATION, Tokyo (JP)

(72) Inventors: Satoshi Saburi, Tokyo (JP); Naoyuki Nagai, Tokyo (JP); Hiroyuki Miyata, Hiroshima (JP); Naoto Yonemura, Hiroshima (JP); Koichi Mizushita, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 120 days.

(21) Appl. No.: 16/078,819

(22) PCT Filed: Feb. 26, 2016

(86) PCT No.: PCT/JP2016/055860
§ 371 (c)(1),
(2) Date: Aug. 22, 2018

(87) PCT Pub. No.: WO2017/145368
PCT Pub. Date: Aug. 31, 2017

(65) Prior Publication Data

US 2019/0093672 A1 Mar. 28, 2019

(51) Int. Cl.
*F04D 29/58* (2006.01)
*F04B 39/06* (2006.01)
(Continued)

(52) U.S. Cl.
CPC ..... *F04D 29/5826* (2013.01); *F04B 39/06* (2013.01); *F28D 7/16* (2013.01);
(Continued)

(58) Field of Classification Search
CPC .... F04D 29/58; F04D 29/582; F04D 29/5826; F04D 29/66; F04D 29/661; F28F 9/0265;
(Continued)

(56) References Cited

U.S. PATENT DOCUMENTS 4,318,669 A 3/1982 Wennerstrom
5,186,249 A * 2/1993 Bhatti ..... F28F 9/0212 165/174
(Continued)

FOREIGN PATENT DOCUMENTS

JP H11-083382 A 3/1999
JP 2000-088477 A 3/2000
(Continued)

OTHER PUBLICATIONS

International Search Report for corresponding International Application No. PCT/JP2016/055860, dated May 31, 2016 (4 pages).
(Continued)

*Primary Examiner* — Igor Kershteyn
*Assistant Examiner* — Elton K Wong
(74) *Attorney, Agent, or Firm* — Osha Bergman Watanabe & Burton LLP

(57) ABSTRACT

A cooling device includes a cooler disposed inside a shell, an inlet nozzle that is configured to feed a fluid into the shell, an outlet nozzle that is configured to feed the fluid passing through the cooler so as to flow outward, and a guide member that is configured to change a flowing direction of the fluid. The guide member has a collision surface which spreads in an inclined direction inclined with respect to the flowing direction of the fluid fed into the shell from the inlet nozzle, and which collides with the fluid, and an uneven portion formed in at least a portion of a peripheral edge portion of the collision surface.

16 Claims, 6 Drawing Sheets

(51) Int. Cl.
*F28D 7/16* (2006.01)
*F28F 9/02* (2006.01)
*F28F 9/22* (2006.01)

(52) U.S. Cl.
CPC ..... *F28F 9/0265* (2013.01); *F28F 9/22* (2013.01); *F28F 2009/222* (2013.01); *F28F 2009/224* (2013.01)

(58) Field of Classification Search
CPC .. F28F 9/22; F28F 2009/222; F28F 2009/224; F01D 25/12; F28D 7/16; F04B 39/06
See application file for complete search history.

(56) References Cited

U.S. PATENT DOCUMENTS 6,866,474 B2 * 3/2005 Uselton ..... F04D 29/703 415/121.2
8,939,732 B2 1/2015 Kim et al.
2007/0215330 A1 * 9/2007 Umetsu ..... F28F 1/325 165/160
2012/0100015 A1 * 4/2012 Kim ..... F04D 17/12 417/244
2014/0000841 A1 * 1/2014 Baker ..... F28F 17/005 165/59
2014/0105733 A1 * 4/2014 Kato ..... F04D 29/5826 415/176
2014/0161588 A1 6/2014 Miyata et al.

FOREIGN PATENT DOCUMENTS

JP 2004-093032 A 3/2004
JP 2013-036375 A 2/2013

OTHER PUBLICATIONS

Written Opinion for corresponding International Application No. PCT/JP2016/055860, dated May 31, 2016 (14 pages).

* cited by examiner

COOLING DEVICE AND COMPRESSOR SYSTEM

TECHNICAL FIELD

The present invention relates to a cooling device and a compressor system.

BACKGROUND ART

A centrifugal compressor compresses a fluid in a gaseous state by circulating the fluid inside a rotating impeller. In some cases, in order to achieve enlarged capacity, this centrifugal compressor includes a plurality of stages of compressors having the impeller.

For example, Patent Document 1 discloses a compressor system configured to include an output shaft that is rotatably driven by an electric motor, a plurality of pinion gears connected to the output shaft via a bull gear, and a compressor disposed in both ends of the respective pinion gears. According to the compressor system, two first stage compressors are disposed in both ends of a first pinion gear, and a second stage compressor and a third stage compressor are disposed in both ends of a second pinion gear. A fluid is compressed by the two first stage compressors, and thereafter, the fluid is compressed sequentially by the second stage compressor and the third stage compressor.

In this way, the compressor system including the plurality of stages of compressors is provided with an intercooler, for example, which serves as a cooling device disposed between the first stage compressor and the second stage compressor. The intercooler cools the fluid compressed and heated by the two first stage compressors on a front stage side. In this manner, filling efficiency of the fluid is improved in the second stage compressor on a rear stage side.

Incidentally, the above-described cooling device such as the intercooler has a hollow shell and a cooling unit disposed inside the shell. The fluid compressed by the compressor on the front stage side flows into the shell from an inlet formed in the shell. The fluid flowing into the shell is cooled by heat exchange with a refrigerant in the cooling unit. The cooled fluid is fed outward of the shell from an outlet, and is supplied to the compressor on the rear stage side.

CITATION LIST

Patent Literature

[Patent Document 1] U.S. Pat. No. 8,939,732

SUMMARY OF INVENTION

Technical Problem

However, according to the cooling device described above, when the fluid flows into the shell, the fluid collides with a member of the cooling unit which is disposed inside the shell, thereby separating the fluid or causing a swirl. As a result, a member inside the shell or the shell itself resonates and generates noise in some cases. Therefore, it is desired for the cooling device to reduce this noise.

This invention aims to provide a cooling device and a compressor system which can reduce noise.

Solution to Problem

According to a first aspect of this invention, there is provided a cooling device for cooling a fluid fed into a compressor. The cooling device includes a hollow shell, a cooler disposed inside the shell, an inlet nozzle that is configured to feed the fluid into the shell, an outlet nozzle that is configured to feed the fluid passing through the cooler so as to flow outward of the shell, and a guide member that is configured to change a flowing direction of the fluid fed into the shell from the inlet nozzle. The guide member has a collision surface which spreads in an inclined direction inclined with respect to the flowing direction of the fluid fed into the shell from the inlet nozzle, and which collides with the fluid, and an uneven portion formed in at least a portion of a peripheral edge portion of the collision surface so that an concavo-convex shape is continuous along the peripheral edge portion.

According to this configuration, the fluid fed into the shell from the inlet nozzle is fed to a cooling unit after the flowing direction is changed by the guide member. Therefore, it is possible to suppress a possibility that the fluid fed from the inlet nozzle may directly collide with the cooler disposed inside the shell. Furthermore, in the guide member, the uneven portion is formed in the peripheral edge portion of the collision surface. Accordingly, it is possible to suppress strength of a swirl generated when the fluid is separated in the peripheral edge portion of the collision surface.

According to a second aspect of this invention, in the cooling device according to the first aspect, the uneven portion may be formed in the peripheral edge portion located on a downstream side in the flowing direction of the fluid flowing along the collision surface, which is on one side in the inclined direction, in the peripheral edge portion.

The fluid fed into the shell from the inlet nozzle and colliding with the collision surface of the guide member flows along the inclined direction of the guide member. The strength of the swirl generated when the fluid is separated on the downstream side in the flowing direction of the fluid flowing along the collision surface can be more effectively suppressed by the uneven portion.

According to a third aspect of this invention, in the cooling device according to the first aspect or the second aspect, the uneven portion may be formed in the peripheral edge portion located on a side intersecting the inclined direction of the guide member, in the peripheral edge portion.

It is possible to suppress influence of the swirl generated when a portion of the fluid flowing in a direction intersecting the inclined direction is separated on the side of the collision surface.

According to a fourth aspect of this invention, the cooling device according to any one of the first aspect to the third aspect may further include a plurality of the inlet nozzles. The guide member may be disposed for each of the inlet nozzles, and all of the guide members may be arranged apart from each other.

In this manner, while the flowing direction of the fluid fed into the shell from each of the inlet nozzles is changed by the guide member, the occurrence of the swirl is suppressed. Accordingly, noise generation can be suppressed. Here, the guide members are arranged apart from each other for each of the inlet nozzles. Accordingly, a size of each guide member can be reduced. In this manner, the guide member can be incorporated into the shell through the inlet nozzle, for example. The guide member can be easily attached to the previously installed cooling device.

According to a fifth aspect of this invention, there is provided a compressor system including a plurality of compressors that are disposed in series so as to sequentially compress fluids, and a cooling device according to any one of the first aspect to the fourth aspect. The cooling device is disposed between a plurality of the compressors, and cools the fluids compressed by the compressor located on a front stage side so as to feed the fluids into the compressor located on a rear stage side.

In this manner, while the noise generated when the fluid flows into the cooling device is suppressed, the fluid can be cooled so as to operate the compressor located on the rear stage.

Advantageous Effects of Invention

According to the cooling device and the compressor system which are described above, it is possible to reduce the noise generated when the fluid flows into the cooling device.

DESCRIPTION OF EMBODIMENTS

Figure 1:
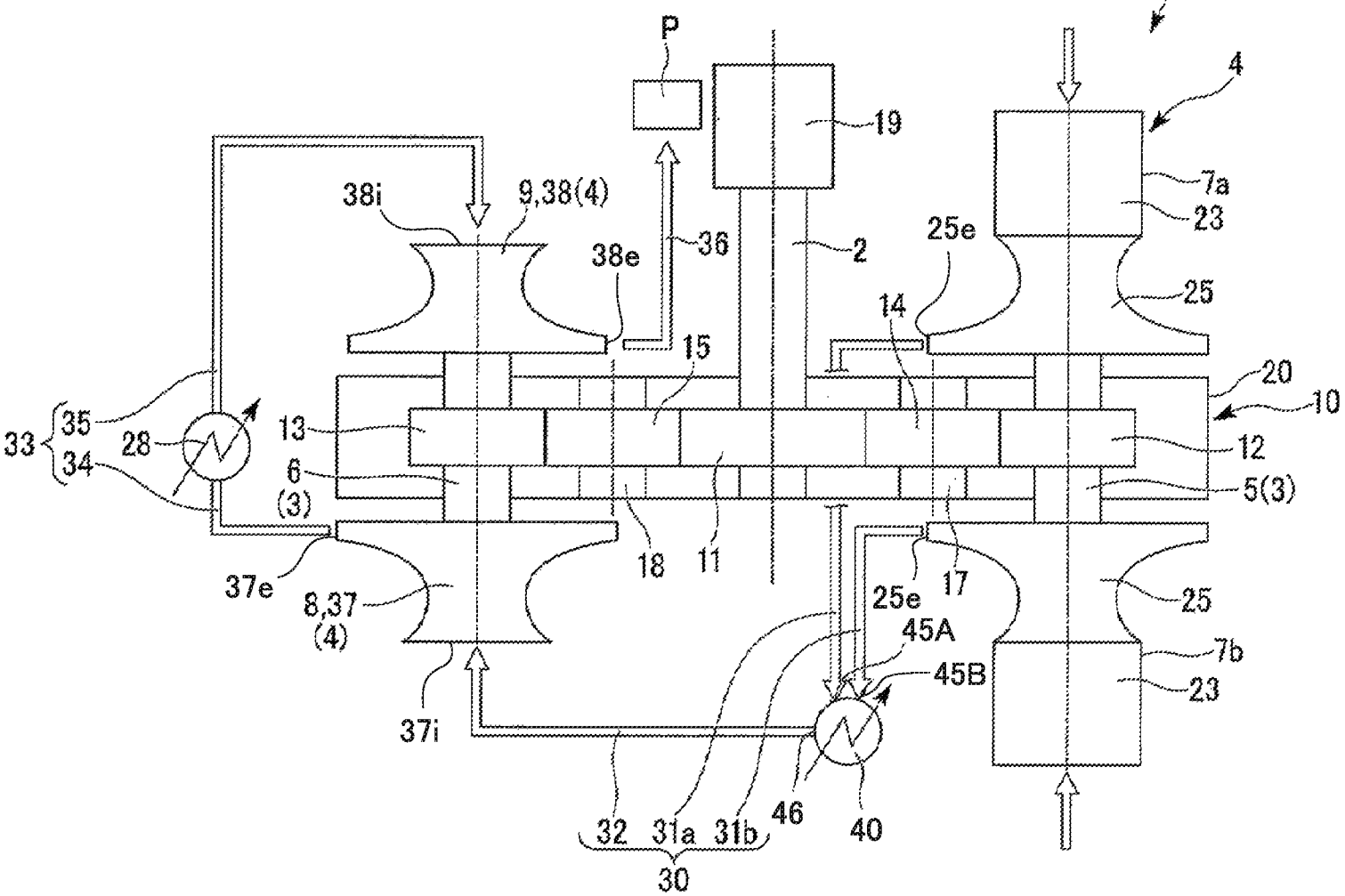
FIG. 1 is a view showing a schematic configuration of a compressor system according to an embodiment of this invention.

FIG. 1 is a view showing a schematic configuration of a compressor system according to an embodiment of this invention.

As shown in FIG. 1, a centrifugal compressor system (compressor system) 1 includes a driving source 19 for generating power, a driving shaft 2, a driven shaft 3, a compressor 4, a speed-increasing gear 10, a first cooling device (cooling device) 40, and a second cooling device 28.

The driving shaft 2 is driven so as to rotate around a central axis thereof by the driving source 19.

The driven shaft 3 is driven so as to rotate around a central axis thereof by the power transmitted from the speed-increasing gear 10. The driven shaft 3 has a first driven shaft 5 and a second driven shaft 6 which are arranged on both sides across the driving shaft 2 and which respectively extend parallel to the driving shaft 2.

The speed-increasing gear 10 accelerates the rotation of the driving shaft 2, and transmits the accelerated rotation to the first driven shaft 5 and the second driven shaft 6. Inside a casing 20, the speed-increasing gear 10 includes a driving gear 11, a first driven gear 12, a second driven gear 13, a first intermediate gear 14, and a second intermediate gear 15.

The driving gear 11 is disposed in a tip portion of the driving shaft 2 inserted into the casing 20 after penetrating the casing 20, and is rotated integrally with the driving shaft 2. Here, the driving shaft 2 is supported by the casing 20 via a bearing (not shown).

The first driven gear 12 is disposed integrally with the first driven shaft 5. The second driven gear 13 is disposed integrally with the second driven shaft 6. The first driven shaft 5 and the second driven shaft 6 are supported by the casing 20 via bearings (not shown). The first driven gear 12 and the second driven gear 13 are respectively arranged apart from each other on both sides across the driving gear 11.

The first intermediate gear 14 is located between the driving gear 11 and the first driven gear 12. The first intermediate gear 14 meshes with the driving gear 11 and the first driven gear 12. The second intermediate gear 15 is located between the driving gear 11 and the second driven gear 13. The second intermediate gear 15 meshes with the driving gear 11 and the second driven gear 13. The first intermediate gear 14 and the second intermediate gear 15 are so-called idle gears.

In this speed-increasing gear 10, if the driving shaft 2 is rotated by a driving force of the driving source 19, the driving gear 11 is rotated integrally with the driving shaft 2. The rotation of the driving gear 11 is transmitted to the first driven gear 12 and the second driven gear 13 via the first intermediate gear 14 and the second intermediate gear 15, and the first driven gear 12 and the second driven gear 13 are rotated. In response to the rotation of the first driven gear 12, the first driven shaft 5 is rotated. In response to the rotation of the second driven gear 13, the second driven shaft 6 is rotated. That is, the driving shaft 2 is driven, thereby rotating the first driven shaft 5 and the second driven shaft 6.

A plurality of the compressors 4 are disposed in series. The compressors 4 sequentially compress the fluid. Each of the compressor 4 is driven by the power transmitted from the driving shaft 2 to the driven shaft 3 via the speed-increasing gear 10. Each of the compressors 4 includes two first stage compressors (compressors) 7*a* and 7*b*, a second stage compressor (compressor) 8, and a third stage compressor (compressor) 9.

The first stage compressors 7*a* and 7*b* are the compressor into which a fluid F flows first in the centrifugal compressor system 1. The first stage compressors 7*a* and 7*b* are respectively disposed in both side end portions in a central axis direction of the first driven shaft 5. The two first stage compressors 7*a* and 7*b* have the same configuration, and respectively include a gas introduction portion 23 and an impeller 25.

The gas introduction portion 23 introduces the fluid F serving as a compression target from the outside.

The impeller 25 is attached to the first driven shaft 5 so as to compress the fluid F supplied from the gas introduction portion 23.

The second stage compressor 8 is disposed in an end portion opposite to a side where the driving source 19 is disposed in the second driven shaft 6. The second stage compressor 8 has an impeller 37 for compressing the fluid F.

The third stage compressor 9 is disposed on a side which is the same side as the side where the driving source 19 is disposed in the second driven shaft 6. The third stage compressor 9 has an impeller 38 for compressing the fluid F.

Next, a connection configuration between the compressors will be described.

The two first stage compressors 7*a* and 7*b* are connected to the second stage compressor 8 via a first stage pipe 30. The first stage pipe 30 is configured to include two first stage compressor discharge pipes 31*a* and 31*b* and a second stage compressor suction pipe 32.

The first stage compressor discharge pipes 31*a* and 31*b* are connected to a gas outlet 25*e* of the first stage compressors 7*a* and 7*b*.

The second stage compressor suction pipe 32 is connected to a gas inlet 37*i* of the second stage compressor 8.

A first cooling device 40 is located between the first stage compressor discharge pipes 31*a* and 31*b* and the second stage compressor suction pipe 32. The first stage compressor discharge pipes 31*a* and 31*b* are connected to the first cooling device 40. The second stage compressor suction pipe 32 is connected to the first cooling device 40.

The first cooling device 40 is disposed between a plurality of the compressors 4. The first cooling device 40 cools the fluid to be fed into the second stage compressor 8. The first cooling device 40 cools the fluid F compressed by two systems of the first stage compressors 7*a* and 7*b* located on a front stage side, and feeds the fluid F into the second stage compressor 8 located on a rear stage side. That is, the first cooling device 40 cools the fluid F discharged from the first stage compressors 7*a* and 7*b* and flowing through the first stage compressor discharge pipes 31*a* and 31*b*, and feeds the fluid F to the second stage compressor suction pipe 32. The first cooling device 40 reduces the power needed to drive the second stage compressor 8 by intermediately cooling the fluid F during a compression process.

The second stage compressor 8 is connected to the third stage compressor 9 via a second stage pipe 33. The second stage pipe 33 is configured to include a second stage compressor discharge pipe 34 and a third stage compressor suction pipe 35.

The second stage compressor discharge pipe 34 is connected to a gas outlet 37*e* of the second stage compressor 8. The third stage compressor suction pipe 35 is connected to a gas inlet 38*i* of the third stage compressor 9.

The second cooling device 28 is disposed between the second stage compressor discharge pipe 34 and the third stage compressor suction pipe 35. The second stage compressor discharge pipe 34 is connected to the second cooling device 28. The third stage compressor suction pipe 35 is connected to the second cooling device 28.

The second cooling device 28 is disposed between a plurality of the compressors 4. The second cooling device 28 cools the fluid to be fed into the third stage compressor 9. The second cooling device 28 cools the fluid F compressed by the second stage compressor 8 located on the front stage side, and feeds the fluid F into the third stage compressor 9 located on the rear stage side. That is, the second cooling device 28 cools the fluid F discharged from the second stage compressor 8 and flowing through the second stage compressor discharge pipe 34, and feeds the fluid F to the third stage compressor suction pipe 35. The second cooling device 28 reduces the power needed to drive the third stage compressor 9 by intermediately cooling the fluid F during the compression process.

The third stage compressor discharge pipe 36 is connected to a gas outlet 38*e* of the third stage compressor 9. The third stage compressor discharge pipe 36 is connected to a predetermined plant P serving as a destination for supplying the fluid F.

In the centrifugal compressor system 1 as described above, the fluid F to be compressed is introduced from the two gas introduction portions 23 and 23 configuring the first stage compressors 7*a* and 7*b*, and is compressed in the two first stage compressors 7*a* And 7*b*.

The fluid F compressed in the first stage compressor 7*a* and 7*b* passes through the first stage compressor discharge pipes 31*a* and 31*b*, and is introduced to and merged in the first cooling device 40. The merged fluid F is intermediately cooled in the first cooling device 40, and thereafter, the fluid F is introduced to the second stage compressor 8 after passing through the second stage compressor suction pipe 32.

The fluid F is compressed in the second stage compressor 8, and thereafter, the fluid F is fed into the second cooling device 28 after passing through the second stage compressor discharge pipe 34. The second cooling device 28 intermediately cools the fed fluid F. The Intermediately cooled fluid F is introduced to the third stage compressor 9 after passing through the third stage compressor suction pipe 35.

The fluid F is compressed in the third stage compressor 9, and thereafter, the fluid F is supplied to the predetermined plant P serving as a destination which demands the compressed fluid F after passing through the third stage compressor discharge pipe 36.

Here, a configuration of the first cooling device 40 will be described.

Figure 2:
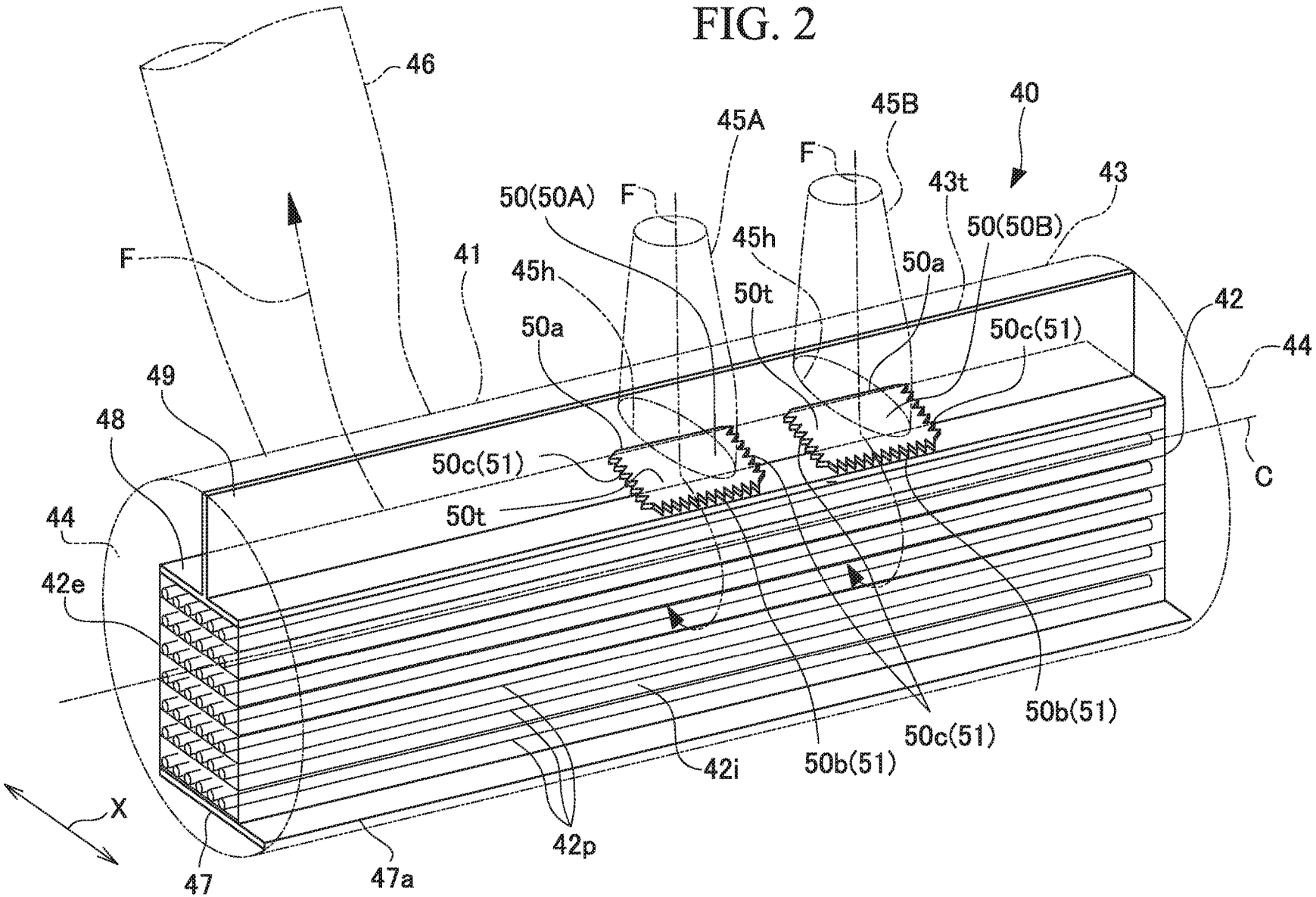
FIG. 2 is a perspective sectional view showing a configuration of a first cooling device disposed in the compressor system according to the embodiment of this invention.
Figure 3:
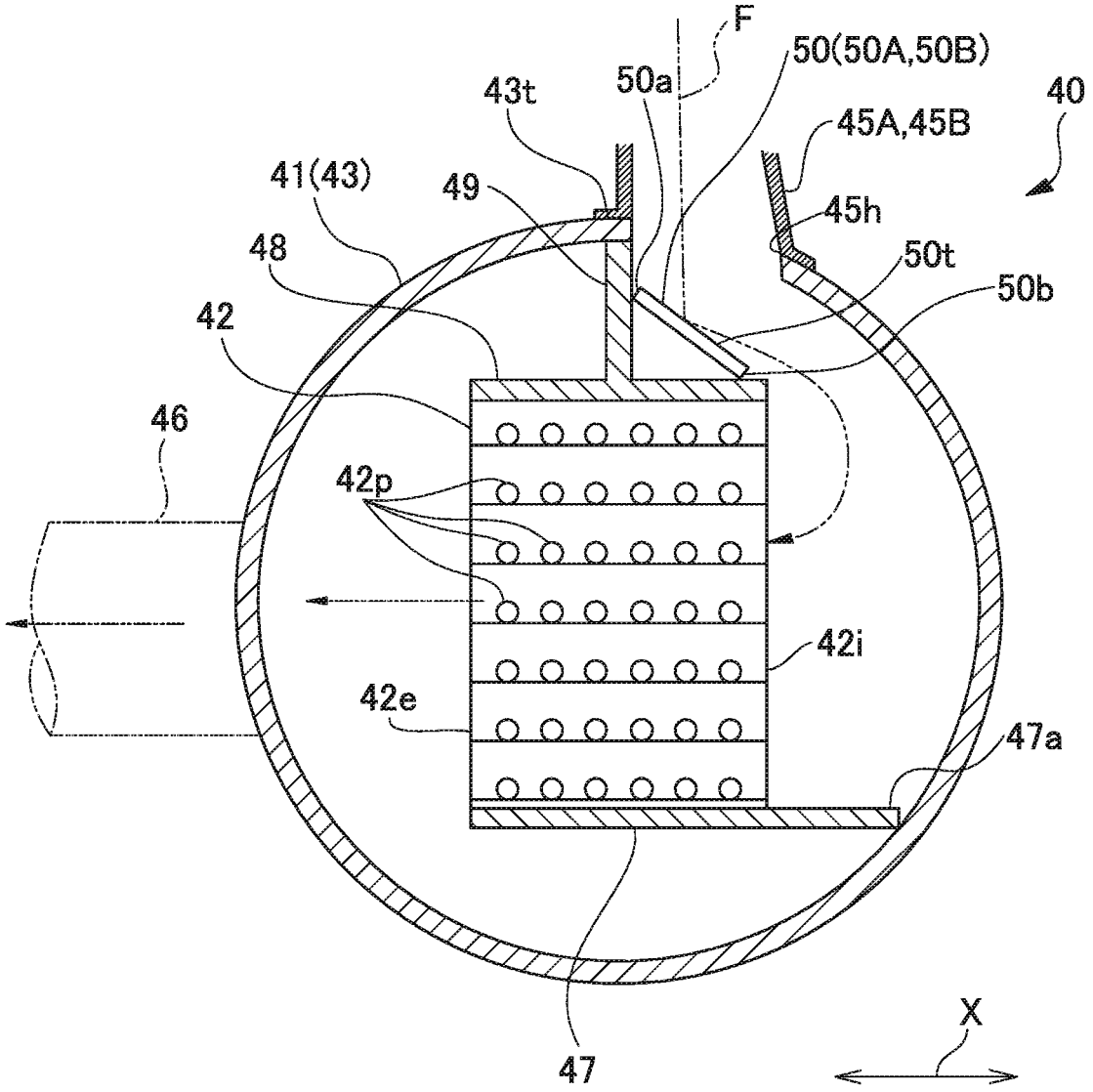
FIG. 3 is a sectional view orthogonal to an axis line of the first cooling device.
Figure 4:
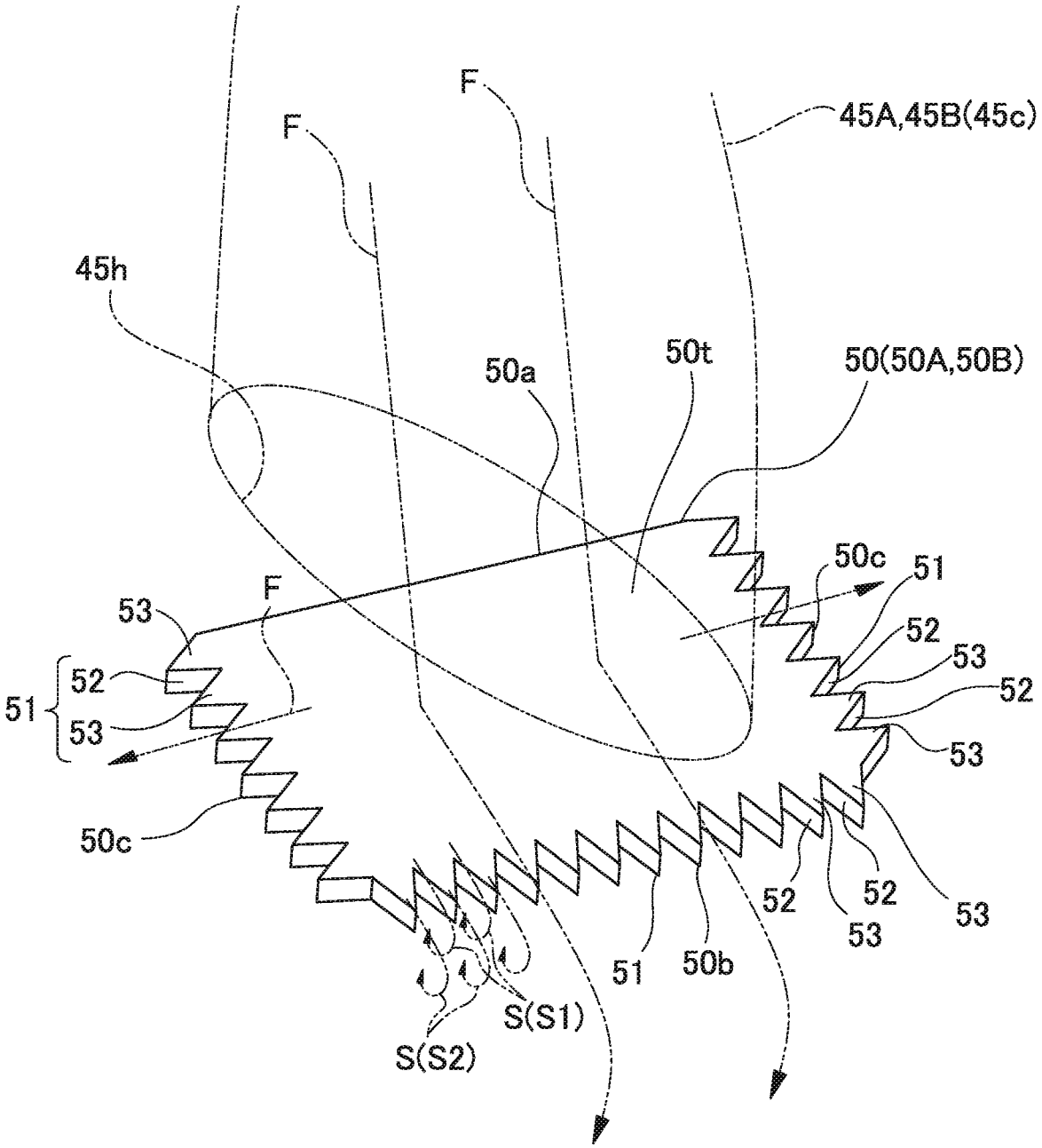
FIG. 4 is a perspective view showing a baffle plate disposed in the first cooling device.

FIG. 2 is a perspective sectional view showing a configuration of the first cooling device disposed in the compressor system according to the embodiment of this invention. FIG. 3 is a sectional view orthogonal to an axis line of the first cooling device. FIG. 4 is a perspective view showing a baffle plate disposed in the first cooling device.

As shown in FIGS. 2 and 3, the first cooling device 40 according to the present embodiment includes a shell 41, a cooler 42, two inlet nozzles 45A and 45B, an outlet nozzle 46, a baffle board (guide member) 50.

The shell 41 has a hollow structure. The shell 41 is a bottomed cylindrical member whose center is an axis line C. The shell 41 according to the present embodiment includes a cylindrical portion 43 having a cylindrical shape and extending in a horizontal direction, and an end plate portion 44 for closing both ends of the cylindrical portion 43.

The two inlet nozzles 45A and 45B and one outlet nozzle 46 are integrally connected to the cylindrical portion 43.

The two inlet nozzles 45A and 45B feed the fluid F into the shell 41. In an upper portion of the cylindrical portion 43, the two inlet nozzles 45A and 45B are arranged apart from each other in a direction of the axis line C of the cylindrical portion 43. As shown in FIG. 2, the inlet nozzles 45A and 45B according to the present embodiment are respectively disposed in the vicinity of a top portion 43*t* located above in a vertical direction of the cylindrical portion 43. The inlet nozzles 45A and 45B are formed at positions offset from the top portion 43*t* to one side in a horizontal direction (hereinafter, referred to as a "width direction X") in a cross section orthogonal to the direction of the axis line C (refer to FIG. 2) of the cylindrical portion 43. The first stage compressor discharge pipe 31*a* is connected to the inlet nozzle 45A. The first stage compressor discharge pipe 31*b* is connected to the inlet nozzle 45B. The inlet nozzles 45A and 45B respectively have an opening portion 45*h* penetrating the cylindrical portion 43.

The outlet nozzle 46 feeds the fluid F passing through the cooler 42 so as to flow outward of the shell 41. The outlet nozzle 46 is located on a side portion of the cylindrical portion 43. The outlet nozzle 46 is formed at a position shifted from the top portion 43*t* to the other side in the width direction X. The second stage compressor suction pipe 32 is connected to the outlet nozzle 46.

The cooler 42 is disposed inside the shell 41. The cooler 42 cools the fluid F flowing from the inlet nozzles 45A and 45B via a coolant. The cooler 42 includes a plurality of pipe bodies 42*p* extending in the direction of the axis line C of the cylindrical portion 43. The coolant such as water is circulated in these pipe bodies 42*p*. The cooler 42 includes a bottom plate 47 supported by the cylindrical portion 43 via a strut (not shown), a top plate 48 for covering an upper portion of the cooler 42, and a partition plate 49 extending upward from the top plate 48.

The bottom plate 47 extends to one side in the width direction X. An end portion 47*a* of the bottom plate 47 is joined to an inner peripheral surface of the cylindrical portion 43. In this manner, the bottom plate 47 vertically partitions a space inside the cylindrical portion 43 in a lower portion of the cooler 42.

The partition plate 49 extends upward in the vertical direction from an intermediate position in the width direction X on an upper surface of the top plate 48. That is, the partition plate 49 is disposed at a central position in the width direction X of the shell 41. The partition plate 49 is joined to an inner peripheral surface side of the cylindrical portion 43 in the top portion 43*t* of the cylindrical portion 43. The partition plate 49 laterally partitions the space inside the cylindrical portion 43 in the upper portion of the cooler 42.

The space inside the cylindrical portion 43 is partitioned to an inlet side 42*i* (right side in FIG. 3) and an outlet side 42*e* (left side in FIG. 3) with respect to the cooler 42 by the bottom plate 47 and the partition plate 49. The inlet side 42*i* is one side in the width direction X which is a side where the inlet nozzles 45A and 45B are connected to the cooler 42. The outlet side 42*e* is the other side in the width direction X which is a side where the outlet nozzle 46 is connected to the cooler 42.

A baffle board 50 changes the flowing direction of the fluid F fed into the shell 41 from the inlet nozzles 45A and 45B. The baffle board 50 is disposed on the top plate 48 of the cooler 42. The baffle board 50 is located below in the vertical direction of at least the opening portion 45*h* of the respective inlet nozzles 45A and 45B. The baffle board 50 according to the present embodiment is disposed for each of the inlet nozzles, and the baffle boards 50 are arranged apart from each other. The baffle board 50 has a rectangular plate shape. The baffle board is inclined so as to be gradually lowered from a first end portion 50*a* on a side close to the partition plate 49 toward a second end portion 50*b* on a side away from the partition plate 49 in the width direction X. That is, the baffle board 50 is inclined downward in the vertical direction, as the baffle board 50 goes outward from the central position in the width direction X in a cross section orthogonal to the direction of the axis line C. The first end portion 50*a* of the baffle board 50 is fixed to the partition plate 49 at a position separated upward in the vertical direction from the top plate 48. The second end portion 50*b* of the baffle board 50 is fixed to the top plate 48. The baffle board 50 according to the present embodiment has a collision surface 50*t* and an uneven portion 51.

The collision surface 50*t* is a surface which collides with the fluid flowing from the inlet nozzles 45A and 45B. The collision surface 50*t* spreads in the inclined direction inclined with respect to the flowing direction of the fluid F fed into the shell 41 from the inlet nozzles 45A and 45B. The collision surface 50*t* according to the present embodiment is a flat surface which faces upward in the vertical direction of the baffle board 50.

Here, the collision surface 50*t* of the baffle board 50 according to the present embodiment is the flat surface. However, without being limited to this shape, the collision surface 50*t* may be formed in any shape as long as it spreads in the inclined direction. For example, the collision surface 50*t* may have a projecting surface shape in which a portion between the first end portion 50*a* and the second end portion 50*b* projects upward in the vertical direction, or may have a recessed surface shape in which the portion between the first end portion 50*a* and the second end portion 50*b* is recessed downward in the vertical direction.

Here, as shown in FIG. 2, a baffle board 50A disposed below one inlet nozzle 45A and a baffle board 50B disposed below the other inlet nozzle 45B are disposed apart from each other in the direction of the axis line C of the cylindrical portion 43.

As shown in FIG. 4, the uneven portion 51 is disposed in at least a portion of a peripheral edge portion of the collision surface 50*t*. That is, the uneven portion 51 forms a portion of a side end surface of the baffle board 50 intersecting the collision surface 50*t*. The uneven portion 51 is formed in the peripheral edge portion located on a downstream side in the flowing direction of the fluid F flowing along the collision surface 50*t*, which is one side in the inclined direction, in the peripheral edge portion. The uneven portion 51 is formed in the peripheral edge portion located on a side intersecting the inclined direction of the baffle board 50, in the peripheral edge portion. The uneven portion 51 according to the present embodiment is formed on a side end surface except for the first end portion 50*a* of four side end surfaces around each baffle board 50 having a rectangular plate shape. That is, the uneven portion 51 is formed in the second end portion 50*b*, side end portion 50*c*, and side end portion 50*c* on both sides in the direction of the axis line C. The uneven portion 51 is formed so that an concavo-convex shape is continuous along the peripheral edge portion. Specifically, the uneven portion 51 is formed so that the concavo-convex shape is continuous by a recess portion 52 and a projection portion 53 which are alternately formed.

The projection portion 53 projects outward of the baffle board 50, and projects in a triangular shape outward of the baffle board 50 when viewed in a direction orthogonal to the collision surface 50*t*. The recess portion 52 is recessed in a triangular shape inward of the baffle board 50 when viewed in the direction orthogonal to the collision surface 50*t*. The recess portion 52 is located between the two adjacent projection portions 53 and 53.

According to this configuration, as shown in FIGS. 2 and 3, the fluid F flowing into the shell 41 from the inlet nozzles 45A and 45B collides with the baffle board 50, and the flowing direction of the fluid F is changed. The fluid F whose flowing direction is changed by the baffle board 50 flows in the inclined direction along the collision surface 50*t*. Thereafter, the fluid F follows along the inner peripheral surface of the shell 41, and reaches the inlet side 42*i* side which is one side in the width direction X with respect to the cooler 42 inside the shell 41. The fluid F passes through the cooler 42 while flowing from the inlet side 42*i* toward the outlet side 42*e* which is the other side in the width direction X with respect to the cooler 42. The fluid F comes into contact with the outer peripheral surface of the respective pipe bodies 42*p* of the cooler 42. In this manner, the fluid F is cooled through heat exchange with the coolant flowing into the respective pipe bodies 42*p*. The cooled fluid F after passing through the cooler 42 is fed outward of the shell 41 from the outlet nozzle 46 which is open on the other side of the shell 41.

In this way, the first cooling device 40 has a function of merging and cooling two systems of the fluid F discharged from the two first stage compressors 7*a* and 7*b* so as to form one system of the fluid F.

According to the first cooling device 40 and the centrifugal compressor system 1 of the above-described embodiment, the flowing direction of the fluid F flowing into the shell 41 from the inlet nozzles 45A and 45B is changed by the baffle board 50. Specifically, as shown in FIG. 4, the fluid F flowing into the shell 41 downward in the vertical direction from the inlet nozzles 45A and 45B and colliding with the baffle board 50 is switched so that the flowing direction of the fluid F is oriented along the collision surface 50*t* of the baffle board 50. Therefore, it is possible to suppress a possibility that the fluid F fed from the inlet nozzles 45A and 45B may directly collide with the cooler 42 or the top plate 48 disposed inside the shell 41.

The fluid F whose flowing direction is changed flows from the first end portion 50*a* toward the second end portion 50*b* and both side end portions 50*c* and 50*c*. In the second end portion 50*b* and both side end portions 50*c* and 50*c* of the baffle board 50, the fluid F is separated from the collision surface 50*t* of the baffle board 50. However, the recess portion 52 and the projection portion 53 are alternately formed in the second end portion 50*b* and both side end portions 50*c* and 50*c*. Therefore, positions where the fluid F is separated from the baffle board 50 so as to generate a swirl S are different in the flowing direction of the fluid F between the recess portion 52 and the projection portion 53. Accordingly, a swirl S1 generated at a position of the recess portion 52 and a swirl S2 generated at a position of the projection portion 53 are less likely to be connected to each other. In this manner, it is possible to suppress the influence of the swirl S as a whole, and it is possible to suppress pressure fluctuations in the vicinity of the baffle board 50. Therefore, it is possible to suppress a possibility that the shell 41 or members inside the shell 41 may be resonated due to the influence of the swirl S. As a result, it is possible to reduce the noise generated when the fluid F flows into the first cooling device 40.

In addition, the uneven portion 51 is formed in the second end portion 50*b* located on the downstream side in the inclined direction of the baffle board 50. Therefore, it is possible to suppress the influence of the swirl S generated when the fluid F is separated in the second end portion 50*b* located on the downstream side in the flowing direction of the fluid F. Therefore, it is possible to effectively suppress the influence of the fluid F on the noise in the second end portion 50*b* into which the largest amount of the fluid F colliding with the collision surface 50*t* flows.

In addition, the uneven portion 51 is formed in both side end portions 50*c* and 50*c* of the baffle board 50. In this manner, it is possible to suppress the influence of the swirl S generated when a portion of the fluid F fed into the shell 41 from the inlet nozzles 45A and 45B and flowing in the direction intersecting the inclined direction is separated in both side end portions 50*c* and 50*c*. Accordingly, the uneven portion 51 is disposed in the second end portion 50*b* and both side end portions 50*c* and 50*c*. In this manner, in a wider range, it is possible to suppress the swirl S generated when the fluid F is separated.

In addition, the baffle boards 50 are disposed apart from each other at positions facing the respective opening portions 45*h* of the plurality of inlet nozzles 45A and 45B. In this manner, the flowing direction of the fluid F fed into the shell 41 from the respective inlet nozzles 45A and 45B is changed by the individual baffle board 50. Here, the baffle board 50 is disposed individually for each of the inlet nozzles 45A and 45B. Accordingly, a size of one baffle board 50 can be reduced. In this manner, the baffle board 50 can be incorporated into the shell 41 through the inlet nozzles 45A and 45B, for example. The baffle board 50 can be attached to the previously installed first cooling device 40.

First Modification Example of Embodiment

Figure 5:
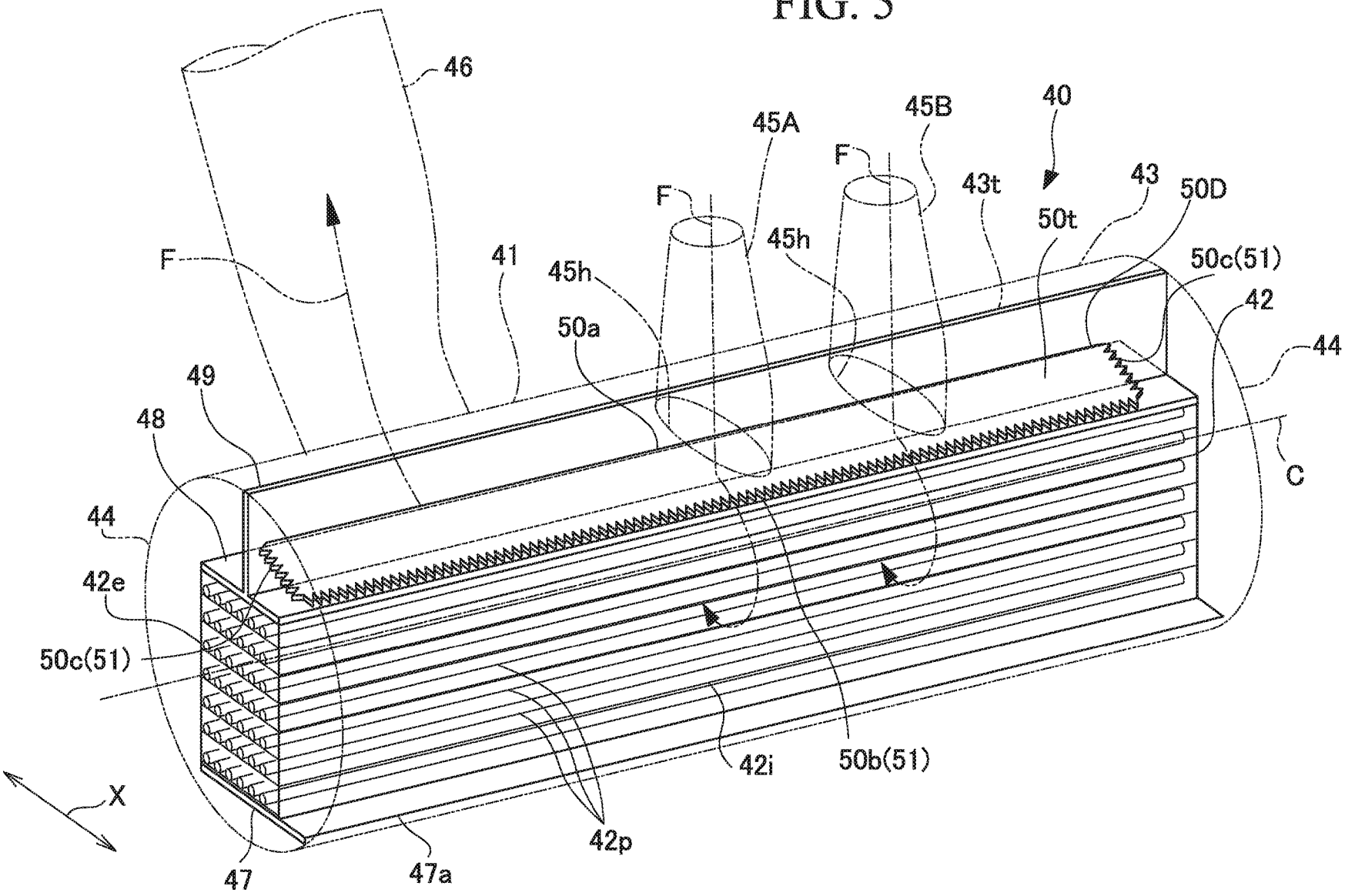
FIG. 5 is a perspective view showing a configuration of a first modification example of a cooling device according to the embodiment of this invention.

In the above-described embodiment, the first cooling device 40 includes the two baffle boards 50 corresponding to each of the two inlet nozzles 45A and 45B. However, the configuration is not limited thereto. FIG. 5 is a perspective view showing a configuration of a first modification example of the cooling device according to the embodiment of the present invention.

As shown in FIG. 5, a baffle board 50D serving as a first modification example may be a single member continuous in the direction of the axis line C of the shell 41. In addition to the position corresponding to the inlet nozzles 45A and 45B, the baffle board 50D may be disposed so as to be continuous throughout the total length of the cooler 42 in the direction of the axis line C of the shell 41.

The uneven portion 51 is formed on a side end surface except for the first end portion 50*a* of four sides around the baffle board 50D. That is, similar to the above-described embodiment, the uneven portion 51 is formed in the second end portion 50*b* and both side end portions 50*c* and 50*c* located on both sides in the direction of the axis line C.

According to the first cooling device 40 including the baffle board 50D having this configuration, similar to the above-described embodiment, the uneven portion 51 is also formed in the second end portion 50*b* and both side end portions 50*c* and 50*c* of the baffle board 50D. Accordingly, it is possible to suppress the strength of the swirl S (refer to FIG. 4) generated when the fluid F is separated in the second end portion 50*b* and both side end portions 50*c* and 50*c* of the collision surface 50*t*. Therefore, it is possible to suppress a possibility that the shell 41 or members inside the shell 41 may be resonated and the noise may be generated due to the influence of the swirl S.

Second Modification Example of Embodiment

In addition, in the above-described embodiment, a configuration in which the first cooling device 40 includes the plurality of inlet nozzles 45A and 45B has been described. However, the configuration is not limited thereto. For example, the number of the inlet nozzles may be three or more. Alternatively, the first cooling device 40 may include one inlet nozzle.

Figure 6:
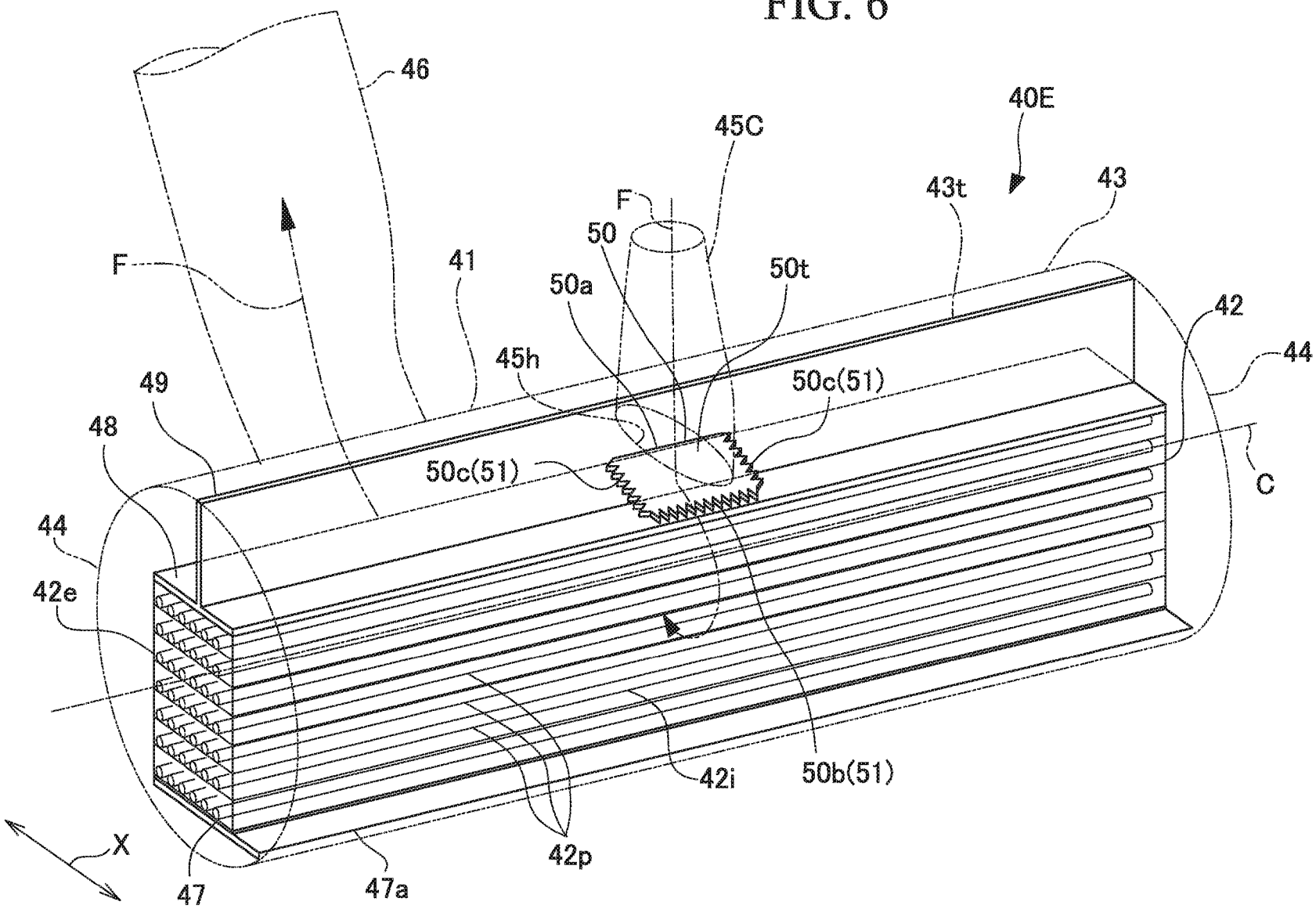
FIG. 6 is a perspective view showing a configuration of a second modification example of the cooling device according to the embodiment of this invention.

FIG. 6 is a perspective view showing a configuration of a second modification example of the cooling device according to the embodiment of this invention.

As shown in FIG. 6, a cooling device 40E shown in the second modification example has one inlet nozzle 45C only.

The baffle board 50 is located below in the vertical direction of the opening portion 45*h* of one inlet nozzles 45C only. The baffle board 50 according to the present embodiment is formed so as to cover only the opening portion 45*h* of the inlet nozzle 45C.

According to the cooling device 40E having this configuration, the flowing direction of the fluid F fed into the shell 41 from the inlet nozzle 45C is also changed by the baffle board 50. Therefore, it is possible to suppress a possibility that the fluid F fed from the inlet nozzle 45C may directly collide with the cooler 42 or the top plate 48 disposed inside the shell 41. Furthermore, the uneven portion 51 is formed in the second end portion 50*b* and both side end portions 50*c* and 50*c* of the baffle board 50. Accordingly, it is possible to suppress the strength of the swirl S (refer to FIG. 4) generated when the fluid F is separated in the second end portion 50*b* and both side end portions 50*c* and 50*c* of the collision surface 50*t*. Therefore, it is possible to suppress a possibility that the shell 41 or members inside the shell 41 may be resonated and the noise may be generated due to the influence of the swirl S.

For example, the cooling device 40E according to the second modification example as described above is applicable to the second cooling device 28 shown in FIG. 1.

Other Embodiments

This invention is not limited to the above-described embodiment, and the design can be modified within a scope not departing from the gist of this invention.

For example, the uneven portion 51 is formed in the second end portion 50*b* and both side end portions 50*c* and 50*c* of the baffle board 50. However, the configuration is not limited thereto. The uneven portion 51 may be formed at least in a portion of the peripheral edge portion of the baffle board 50, or may be formed in only the second end portion 50*b*, for example. In addition, the uneven portion 51 may be formed in only one of both side end portions 50*c* and 50*c*, or may be formed in the whole peripheral edge portion of the baffle board 50.

In addition, the uneven portion 51 is formed using the recess portion 52 and the projection portion 53 which have a triangular shape. However, without being limited to the triangular shape, the recess portion 52 and the projection portion 53 may have any other appropriate shapes, for example, such as a semicircular shape, a parabolic shape, and a rectangular shape.

In addition, in the above-described embodiment, the configuration of the centrifugal compressor system 1 has been described as an example. However, the configuration of each portion such as the number of stages of the compressor and the specific configuration of the speed-increasing gear 10 may be appropriately changed.

INDUSTRIAL APPLICABILITY

In the guide member inclined with respect to the flowing direction of the fluid, the uneven portion is formed in at least a portion of the peripheral edge portion of the collision surface with which the fluid collides. In this manner, it is possible to reduce the noise generated when the fluid flows into the cooling device.

REFERENCE SIGNS LIST

1 centrifugal compressor system (compressor system)
2 driving shaft
3 driven shaft
4 compressor
5 first driven shaft
6 second driven shaft
7*a*, 7*b* first stage compressor
8 second stage compressor
9 third stage compressor
10 speed-increasing gear
11 driving gear
12 first driven gear
13 second driven gear
14 first intermediate gear
15 second intermediate gear
17 first intermediate shaft
18 second intermediate shaft
19 driving source
20 casing
23 gas introduction portion
24 inlet guide vane
25 impeller
25*e* gas outlet
26 actuator
28 second cooling device
30 first stage pipe
31*a*, 31*b* first stage compressor discharge pipe
32 second stage compressor suction pipe
33 second stage pipe
34 second stage compressor discharge pipe
35 third stage compressor suction pipe
36 third stage compressor discharge pipe
37 impeller
37*e* gas outlet
37*i* gas inlet
38 impeller
38*e* gas outlet
38*i* gas inlet
40 first cooling device (cooling device)
40E cooling device
41 shell
42 cooler
42*e* outlet side
42*i* inlet side
42*p* pipe body
43 cylindrical portion
43*t* top portion
44 end plate portion
45A, 45B, 45C inlet nozzle
45*h* opening portion
46 outlet nozzle
47 bottom plate
48 top plate
49 partition plate
50 baffle board (guide member)
50A, 50B, 50D baffle board
50*a* first end portion
50*b* second end portion
50*c* side end portion
50*t* collision surface
51 uneven portion
52 recess portion
53 projection portion
C axis line
F fluid
P plant
S, S1, S2 swirl
X width direction

What is claimed is:

1. A cooling device for cooling a fluid fed into a compressor, the cooling device comprising:

a hollow shell which is a bottomed cylindrical member whose center is an axis line and extends in a horizontal direction;

a cooler disposed inside the shell;

an inlet nozzle that is configured to feed the fluid into the shell from above the cooler in a vertical direction, wherein the vertical direction is with respect to a cross sectional view that is orthogonal to the axis line along which the shell extends;

an outlet nozzle that is configured to feed the fluid passing through the cooler so as to flow outward of the shell; and a guide member that has a rectangular plate shape and is configured to change a flowing direction of the fluid fed into the shell from the inlet nozzle toward an inner peripheral surface of the shell, wherein the cooler includes:

a plurality of pipe bodies extending in the direction of the axis line, a top plate which covers the plurality of pipe bodies from above in the vertical direction and is formed in a flat plate shape, a partition plate extending upward in the vertical direction from the top plate and joined to the inner peripheral surface of the shell, and a bottom plate arranged below the plurality of pipe bodies in the vertical direction and joined to the inner peripheral surface of the shell, wherein the guide member has a collision surface which spreads in an inclined direction inclined with respect to the flowing direction of the fluid fed into the shell from the inlet nozzle, and which collides with the fluid, and an uneven portion formed in at least a portion of a peripheral edge portion of the collision surface so that an uneven shape is continuous along the peripheral edge portion, wherein a space inside the shell is partitioned into a space on an inlet side connected to the inlet nozzle and a space on an outlet side connected to the outlet nozzle by the partition plate and the bottom plate, wherein the cooler is configured to cool the fluid that flows under the top plate from the space on the inlet side of the shell toward the space on the outlet side of the shell in a width direction orthogonal to the axis line by contacting the fluid with an outer peripheral surface of each of the plurality of pipe bodies, and wherein the guide member is inclined downward in the vertical direction as the guide member extends outward from a central position in the width direction in the cross sectional view with the collision surface facing upward in the vertical direction to change the flowing direction of the fluid toward the inner peripheral surface of the shell and disposed on the top plate.

2. The cooling device according to claim 1, wherein the uneven portion is formed in the peripheral edge portion located on a downstream side in the flowing direction of the fluid flowing along the collision surface, which is on one side in the inclined direction, in the peripheral edge portion.

3. The cooling device according to claim 2, wherein the uneven portion is formed in the peripheral edge portion located on a side intersecting the inclined direction of the guide member, in the peripheral edge portion.

4. The cooling device according to claim 3, further comprising:

a plurality of the inlet nozzles, and a plurality of guide members, wherein a guide member of the plurality of guide members is disposed for each of the inlet nozzles, and all of the guide members are arranged apart from each other.

5. A compressor system comprising:

a plurality of compressors that are disposed in series so as to sequentially compress fluids; and the cooling device according to claim 4, wherein the cooling device is disposed between a plurality of the compressors, and cools the fluids compressed by the compressor located on a front stage side so as to feed the fluids into the compressor located on a rear stage side.

6. A compressor system comprising:

a plurality of compressors that are disposed in series so as to sequentially compress fluids; and the cooling device according to claim 3, wherein the cooling device is disposed between a plurality of the compressors, and cools the fluids compressed by the compressor located on a front stage side so as to feed the fluids into the compressor located on a rear stage side.

7. The cooling device according to claim 2, further comprising:

a plurality of the inlet nozzles, and a plurality of guide members, wherein a guide member of the plurality of guide members is disposed for each of the inlet nozzles, and all of the guide members are arranged apart from each other.

8. A compressor system comprising:

a plurality of compressors that are disposed in series so as to sequentially compress fluids; and the cooling device according to claim 7, wherein the cooling device is disposed between a plurality of the compressors, and cools the fluids compressed by the compressor located on a front stage side so as to feed the fluids into the compressor located on a rear stage side.

9. A compressor system comprising:

a plurality of compressors that are disposed in series so as to sequentially compress fluids; and the cooling device according to claim 2, wherein the cooling device is disposed between a plurality of the compressors, and cools the fluids compressed by the compressor located on a front stage side so as to feed the fluids into the compressor located on a rear stage side.

10. The cooling device according to claim 1, wherein the uneven portion is formed in the peripheral edge portion located on a side intersecting the inclined direction of the guide member, in the peripheral edge portion.

11. The cooling device according to claim 10, further comprising:

a plurality of the inlet nozzles, and a plurality of guide members, wherein a guide member of the plurality of guide members is disposed for each of the inlet nozzles, and all of the guide members are arranged apart from each other.

12. A compressor system comprising:

a plurality of compressors that are disposed in series so as to sequentially compress fluids; and the cooling device according to claim 11, wherein the cooling device is disposed between a plurality of the compressors, and cools the fluids compressed by the compressor located on a front stage side so as to feed the fluids into the compressor located on a rear stage side.

13. A compressor system comprising:

a plurality of compressors that are disposed in series so as to sequentially compress fluids; and the cooling device according to claim 10, wherein the cooling device is disposed between a plurality of the compressors, and cools the fluids compressed by the compressor located on a front stage side so as to feed the fluids into the compressor located on a rear stage side.

14. The cooling device according to claim 1, further comprising:

a plurality of the inlet nozzles, and a plurality of guide members, wherein a guide member of the plurality of guide members is disposed for each of the inlet nozzles, and all of the guide members are arranged apart from each other.

15. A compressor system comprising:

a plurality of compressors that are disposed in series so as to sequentially compress fluids; and the cooling device according to claim 14, wherein the cooling device is disposed between a plurality of the compressors, and cools the fluids compressed by the compressor located on a front stage side so as to feed the fluids into the compressor located on a rear stage side.

16. A compressor system comprising:

a plurality of compressors that are disposed in series so as to sequentially compress fluids; and the cooling device according to claim 1, wherein the cooling device is disposed between a plurality of the compressors, and cools the fluids compressed by the compressor located on a front stage side so as to feed the fluids into the compressor located on a rear stage side.

* * * * *